US008517191B2

(12) United States Patent
Paeth

(10) Patent No.: US 8,517,191 B2
(45) Date of Patent: Aug. 27, 2013

(54) ADJUSTABLE DIVIDER SYSTEM

(75) Inventor: Richard F. Paeth, St. Charles, IL (US)

(73) Assignee: Samaritan Display Group, Inc., Schaumburg, IL (US)

( * ) Notice: Subject to any disclaimer, the term of this patent is extended or adjusted under 35 U.S.C. 154(b) by 48 days.

(21) Appl. No.: 13/204,660

(22) Filed: Aug. 6, 2011

(65) Prior Publication Data

US 2012/0031865 A1 Feb. 9, 2012

Related U.S. Application Data

(60) Provisional application No. 61/400,998, filed on Aug. 6, 2010.

(51) Int. Cl.
*A47F 5/00* (2006.01)

(52) U.S. Cl.
USPC ..... 211/184

(58) Field of Classification Search
USPC ..... 211/184, 51, 50, 59.4
See application file for complete search history.

(56) References Cited

U.S. PATENT DOCUMENTS

| | | | | |
|---|---|---|---|---|
| 4,618,063 | A * | 10/1986 | Mendenhall | 211/184 |
| 4,792,051 | A * | 12/1988 | Miller | 211/184 |
| 5,072,835 | A * | 12/1991 | Price et al. | 211/40 |
| 5,341,945 | A * | 8/1994 | Gibson | 211/184 |
| 5,690,038 | A * | 11/1997 | Merit et al. | 108/60 |
| 6,290,077 | B2 * | 9/2001 | Sosso | 211/189 |

* cited by examiner

*Primary Examiner* — Korie H Chan
(74) *Attorney, Agent, or Firm* — Justin Lampel

(57) ABSTRACT

An adjustable gondola shelving system is disclosed. The system has a plurality of dividers having openings for receiving pins or rivets. The dividers may be angled on the gondola. A product stop bar may extend over the top of the dividers. The product stop may prevent articles displayed on the shelf from being inadvertently pushed to the back of the shelf. The product stop increases the rigidity of the dividers. The dividers may be altered in position with respect to the shelf depending on the article(s) being displayed.

3 Claims, 6 Drawing Sheets

ADJUSTABLE DIVIDER SYSTEM

CROSS REFERENCE TO RELATED APPLICATIONS

The present application is based on U.S. provisional application No. 61/400,998 filed on Aug. 6, 2010, the entire contents of which are incorporated by reference. Applicant claims the priority benefit of the 61/400,998 application.

BACKGROUND OF THE INVENTION

An adjustable gondola shelving system is disclosed. The system has a plurality of dividers having openings for receiving pins or rivets. The dividers may be angled on the gondola. A product stop bar may extend over the top of the dividers. The product stop may prevent articles displayed on the shelf from being inadvertently pushed to the back of the shelf The product stop increases the rigidity of the dividers. The dividers may be altered in position with respect to the shelf depending on the article(s) being displayed.

U.S. Pat. No. 5,871,108 to White discloses a merchandise display shelving arrangement which incorporates a first, gondola-type shelving unit with shelves intended to be loaded from the rear. The shelves may be inclined to promote gravity feeding of merchandise toward the front of the shelves. A second shelving unit is readily movable between a position in which it backs up to the first shelving unit and obstructs access to the rear of the shelves and another position in which it is spaced from the first shelving unit to create an aisle affording access to the rear of the shelves to facilitate loading of merchandise onto the shelves.

U.S. Pat. No. 6,561,365 to Bustos discloses a shelving system comprising a gondola display having two rows of rear-loading shelves arranged back-to back. In one row of shelves, the shelves are hingedly attached to the gondola display, thereby allowing the shelves to be rotated away from the gondola. This exposes both the rear of the rotated shelves and the rear of the shelves located directly behind the rotated shelves, thereby allowing for easy rear-loading of product into both row of shelves at the same time. The present invention can also be used to allow for easy rear-loading of conventional gondola displays having a fixed base or bases. In such instances, a row of rotating shelf units, each having a retractable support wheel, is attached to one side of the conventional gondola. When these units are in their display position and when first rotated away from the gondola, the wheel is in a retracted position so that it is in contact with and can be rolled along the top surface of the fixed base. As the unit is rotated away from the gondola display and into its loading position, the wheel will extend downwardly from the bottom of the unit so that the wheel contacts and moves along the ground surface. In this manner, the retractable wheel is always available to provide support for, and facilitate the rotating movement of, the rotating shelf unit.

However, these adjustable shelving divider systems fail to allow a product to be stored and displayed in the manner described herein. A need, therefore, exists for an improved adjustable shelving divider system.

SUMMARY OF THE INVENTION

An adjustable gondola shelving system is disclosed. The system has a plurality of dividers having openings for receiving pins or rivets. The dividers may be angled on the gondola. A product stop bar may extend over the top of the dividers. The product stop may prevent articles displayed on the shelf from being inadvertently pushed to the back of the shelf. The product stop increases the rigidity of the dividers. The dividers may be altered in position with respect to the shelf depending on the article(s) being displayed.

An advantage of the present system is to provide a system which prevents articles displayed thereon from being pushed to the back of a shelf.

Yet another advantage of the present system is to provide a system which easily may be altered to accommodate different articles for display on a shelf.

Still another advantage of the present system is to provide a system which may be easily assembled and reassembled.

For a more complete understanding of the above listed features and advantages of the present adjustable gondola shelving system, reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

Figure 1:
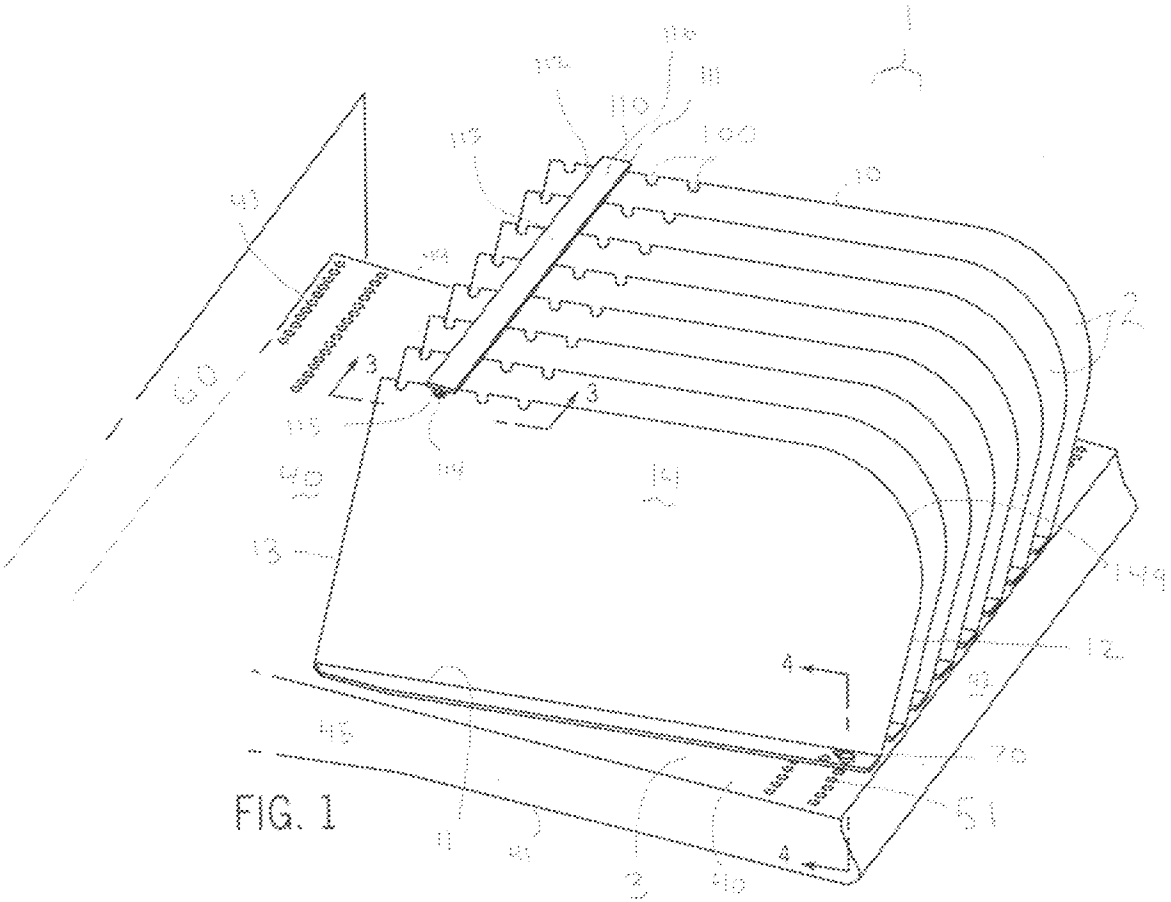
FIG. 1 illustrates a side perspective view of the adjustable gondola shelving system.

An adjustable gondola shelving system is disclosed. The system has a plurality of dividers having openings for receiving pins or rivets. The dividers may be angled on the gondola. A product stop bar may extend over the top of the dividers. The product stop may prevent articles displayed on the shelf from being inadvertently pushed to the back of the shelf. The product stop increases the rigidity of the dividers. The dividers may be altered in position with respect to the shelf depending on the article(s) being displayed.

The adjustable divider system 1 may have a plurality of generally flat dividers 2 which, during use, may be located on a shelf 3. The shelf 3 and the divider 2 may be constructed from plastic, metal or the like. The plurality of dividers 2 may be positioned at different locations on the shelf 3 as will be described below. More specifically, the plurality of dividers 2 may be positioned so that a distance 83 (FIG. 7) between two of the dividers 2 is suitable for securing and displaying a plurality of items 84 (illustrated as oval items) which are placed on the shelf 3. The distance 83 between two dividers 2 may be increased or decreased depending on the items 84 being displayed.

The number of generally flat dividers 2 used on a specific shelf 3 may also be altered depending on the number of rows which the user elects to have on the shelf 3. More specifically, if ten dividers 2 are inserted on a particular shelf 3, nine rows of items 84 may be displayed. The items 84 may be placed one in front of another, similar to that of a vending machine. A product stop 110 (as defined below) may prevent the farthest item 84*a* from the front 42 of the shelf 3 from moving too far from the front 42 of the shelf 3. As a result, the item 84*a* may be prevented from reaching the back 43 of the shelf 3 and/or contacting the wall 60. Therefore, the item 84 may remain easily visible to the consumer, especially when the self 3 is at eye level or above.

The shelf 3 of the system 1 may have a top side 40, a bottom side 41, a front 42, a back 43, a first side 44 and a second side 45. The front 42 of the shelf 3 may face outward toward the consumer whereas the back 43 may face and may be connected to a wall 60 or other supporting device.

Figure 2:
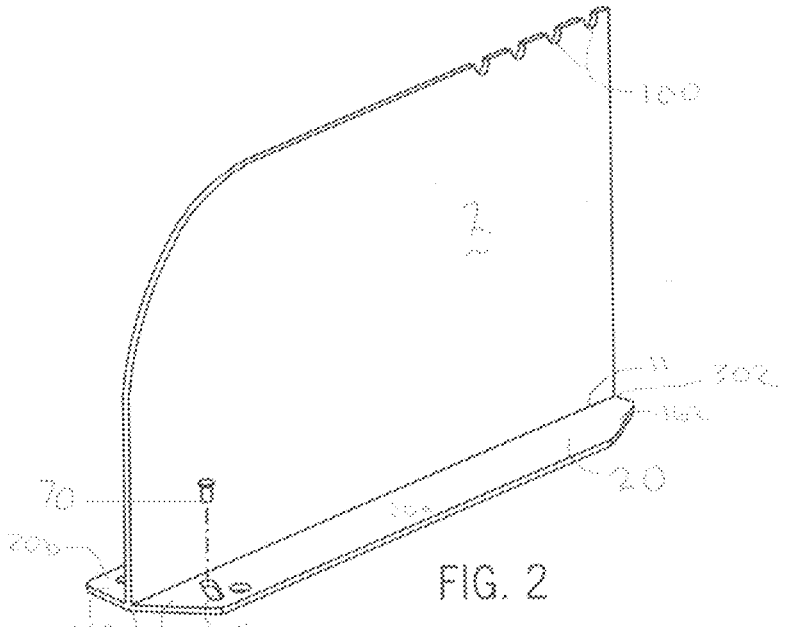
FIG. 2 illustrates a side perspective view of one of the plurality of dividers of the adjustable gondola system.
Figure 5:
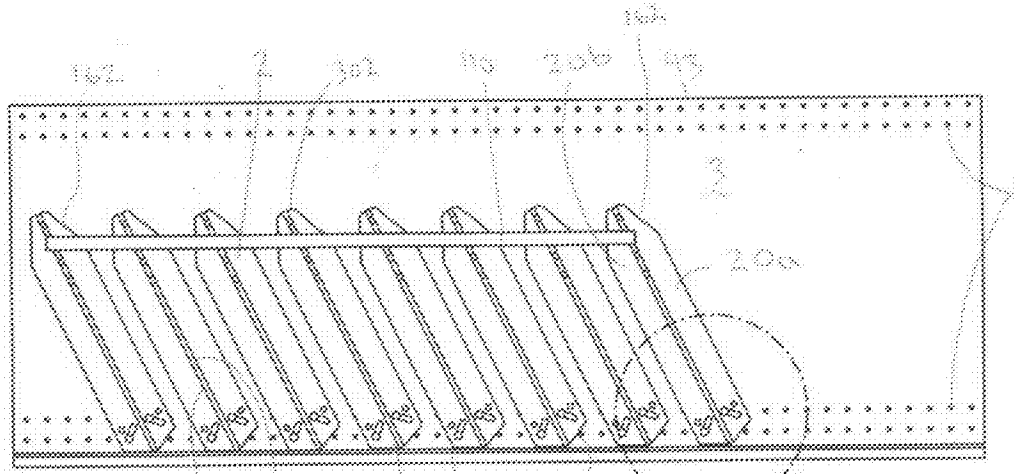
FIG. 5 illustrates a top plan view of the plurality of dividers secured to the shelf at an angle.

Each divider 2 of the plurality of dividers may have a top 10, a bottom 11, a front 12, a back 13, a first side 14 and a second side 15 (FIG. 5). Located at the bottom 11 of the divider 2 may be a base 20 (FIG. 2) having a plurality of openings 50. In an embodiment, the openings 50 are oval so as to allow a pin 70 (as described below) to be inserted therein regardless of an angle 138 the divider 2 is in with respect to the front 42 of the shelf 3. The base 20 may support the divider 2 such that the divider 2 may stand on its bottom 11 in a largely perpendicular manner with respect to the shelf 3. When positioned on the shelf 3, the base 20 may rest substantially flat with respect to the top side 40 of the shelf 3. Further, in an embodiment, the base 20 may be large enough so as to balance the divider 2 and allow the divider 2 to stand in an upright position under normal circumstances. In use, a portion of the plurality of items 84 (FIG. 7) being displayed on the shelf 3 may cover a portion of the top 611 of the base 20. The additional weight of the portion of the items 84 resting on the base 20 may only further prevent movement of the dividers 2 during use. In an embodiment, the front 12 of the plurality of dividers 2 may have a curved portion 149 so as to allow easy access and visibility for the consumer to the items 84 being displayed on the shelf 3.

The base 20 of the dividers 2 may have a first side 20*a* and a second side 20*b* (FIG. 5). The first side 20*a* and the second side 20*b* of the base 20 may be mirror images of each other. The base 20 may also have a front 301 and a back 302. The front 301 and the back 302 of the base 20 may have tapered sections 162. The taped sections 162 may allow the dividers 2 to be used at or near the very front 42 and/or sides 44, 45 of the shelf 3 without a protruding sharp edge of the base 20 extending beyond the front 42 and/or sides 44, 45 of the shelf 3. The angle of the tapered section 162 may be substantially similar to the angle 138 at which the divider 2 is used with respect to the front 42 of the shelf 3.

Figure 6:
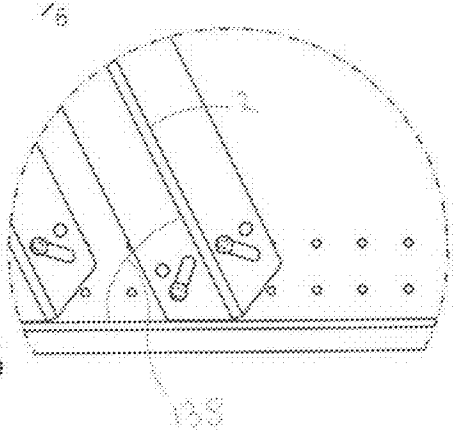
FIG. 6 illustrates a close up view of the connection between the divider and the shelf along segment 6-6 of FIG. 5.
Figure 10:
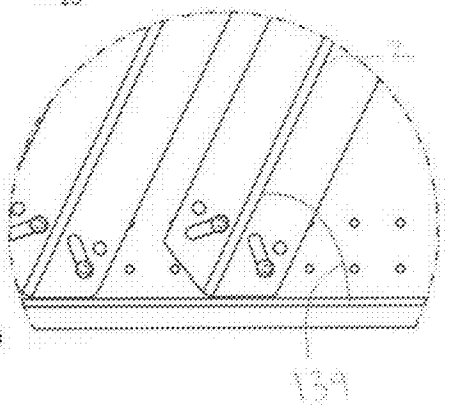
FIG. 10 illustrates a close up along segment 10-10 of FIG. 9.
Figure 11B:
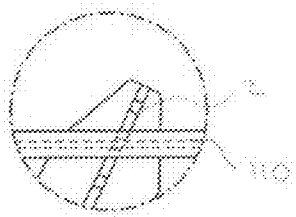
FIG. 11B illustrates a close up along segment 11B-11B of FIG. 9.
Figure 11A:
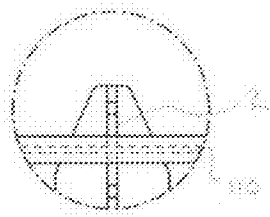
FIG. 11A illustrates a close up along segment 11A-11A of FIG. 7.
Figure 12:
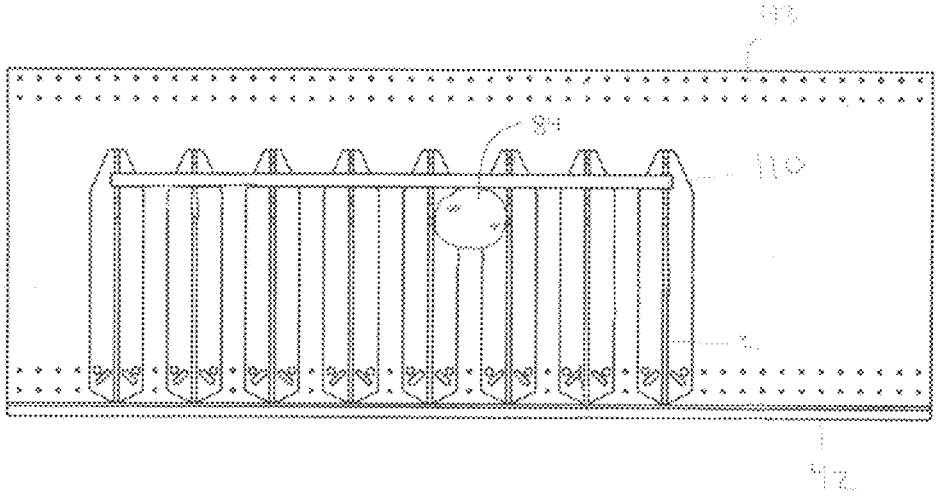
FIG. 12 illustrates the product stop preventing product from reaching the back of the shelf.

The plurality of dividers 2 may be used at various different angles with respect to the front 42 of the shelf 3 provided that all the dividers 2 connected with a single product stop 110 are generally used at the same angle 138 with respect to one another. Although the dividers 2 may rest at any specific angle with respect to the front 42 of the shelf 3, the dividers 2 would typically rest anywhere from fifty degrees to one hundred and thirty degrees with respect to the front 42 of the shelf 3. FIG. 6 illustrates the dividers 2 at an angle 138 of approximately sixty-five degrees with respect to the front 42 of the shelf 3 while FIG. 10 illustrates the dividers 2 at approximately one hundred and fifteen degrees 139 with respect to the front 42 of the shelf 3.

Figure 4:
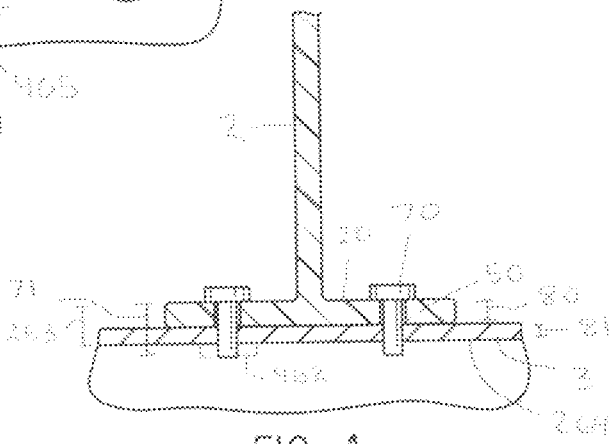
FIG. 4 illustrates a front plan view along line 4-4 wherein one of the plurality of dividers is secured to a shelf.

Located on the top 40 of the shelf 3 may be a plurality of openings 51. The plurality of openings 51 on the top 40 of the shelf 3 may align with the plurality of openings 50 located on the base 20 of the divider 2. A pin or other securing device 70 may be inserted through the openings 50 of the base 20 and then through the opening 51 of the top 40 of the shelf 3. The pin 70 may have a length 71 (FIG. 4) which is greater than the combined height 263 of a height 80 of the base 20 of the divider 2 and a height 81 of the top 40 of the shelf 3. When inserted into the opening 50 of the base 20 and the opening 51 of the shelf 3, the pin 70 may prevent the dividers 2 from moving or otherwise unintentionally shifting while placed on the top 40 of the shelf 3. To remove or otherwise change the position of the divider 2 of the shelf 3, the pin 70 may be removed and the divider 2 moved to a different location or different angle. The pin 70 may be secured into the openings 50 of the base 20 and the openings 51 of the shelf 3 by, for example, gravity, friction and/or a securing device such as a nut 462 applied to the underside 264 of the shelf 3.

Figure 7:
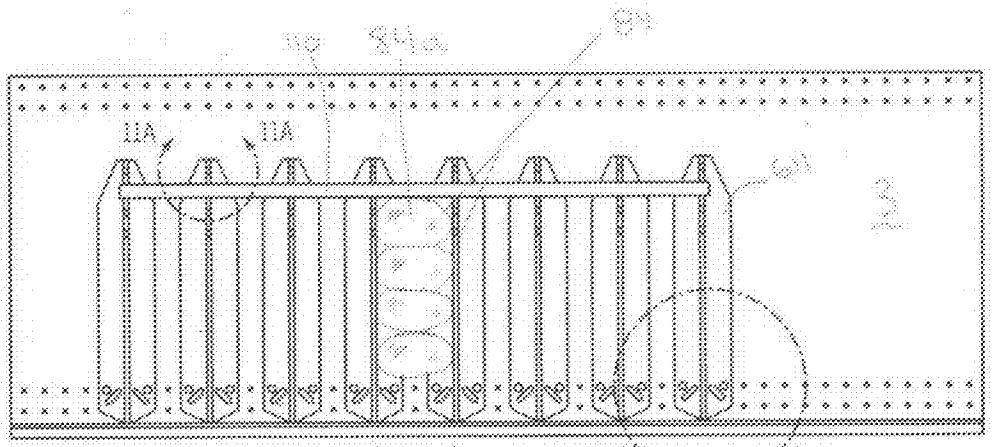
FIG. 7 illustrates a top view of the plurality of dividers connected to the shelf at a largely perpendicular angle.
Figure 8:
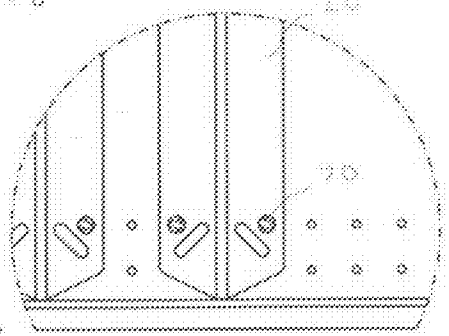
FIG. 8 illustrates a close up view along segment 8-8 of FIG. 7.
Figure 9:
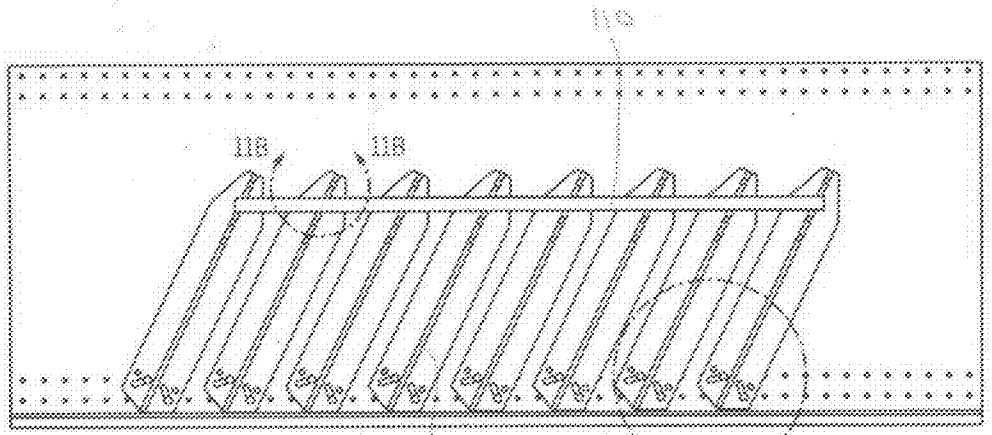
FIG. 9 illustrates a top plan view of the plurality of dividers secured to the shelf at an angle.

In use, the user may alter the angle of the dividers 2 with respect to the front 42 of the shelf 3 by inserting the pin 70 into the desired openings 51 on the shelf 3. FIGS. 5, 7 and 9 illustrate the dividers 2 in three different positions. It should be understood that any number of angles may be used by selectively using the desired openings 51 on the shelf 3 to align with the openings 50 of the dividers 2.

Located at the top 10 of the divider 2 may be a plurality of slots 100 having a width 881. The figures illustrate four slots 100 per divider; however, any number of slots 100 may be used. In an embodiment, the plurality of slots 100 may be located near the back portion 13 of the divider 2. More specifically, the plurality of slots 100 may be located at the opposite end of the divider 2 as the plurality of openings 50 of the base 20 of the dividers 2. The slots 100 of the dividers are illustrated in a largely semi-circular manner; however the slots 100 may be of any suitable shape, as described below. The slots 100 of the dividers 2 may line up so that, for example, all of rear slots 100 of all the dividers 2 on a particular shelf 3 may be located at approximately the same distance and angle with respect to the front 42 of the shelf 3. The shape of the slots 100 is so designed to allow a product stop 110 to be used regardless of the angle the dividers 2 with respect to the front 42 of the shelf 3. In addition, the slots 100 are shaped such that the product stop 110 may be slightly compressed during use (as described below). As a result, the device 1 may be further secured and stable due to the slight compression of the product stop 110. The plurality of the slots 100 in the top of the divider 2 may be adjusted to accommodate various sizes of items 84 to be displayed on the shelf 3.

As stated above, the device may have a product stop 110. The product stop 110 may be placed along the top 10 of the dividers 2. The product stop 110 may have a front 111, a back 112, a top 113, a bottom 114, a first side 115 and a second side 116. The bottom 114 of the product stop 110 may be largely cylindrical such that the bottom 114 of the product stop 110 may fit snugly within a portion of the slots 100 of the dividers 2. The product stop 110 may extend through at least one of the slots 100 of each of the dividers 2 used on the shelf 3. More specifically, while in use, the bottom 114 of the product stop 110 may be inserted at least partly within one of the slots 100 of each of the dividers 2. As a result, the dividers 2 may be connected and may initially move as a single unit while the product stop 110 is inserted through the slots 100.

When the product stop 110 is inserted through, for example, the second rear slot 100 of each of the dividers 2 (as illustrated in FIG. 1), the product stop 110 may force the dividers 2 to be largely parallel with respect to one another and may force the dividers 2 to initially move in unison with respect to one another (the dividers 2 do not move once secured to the shelf 3). Further, the product stop 110 may also add rigidity to the dividers 2 by connecting the dividers 2 to each other. As a result, the system is resistant to unintentional movement.

Figure 13:
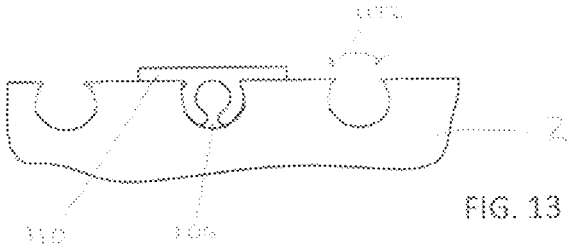
FIG. 13 illustrates a close up view of an embodiment of one of the plurality of dividers wherein the slots allow the product stop to snap into place.

Referring now to FIG. 13, in an embodiment, the plurality of slots 100 may not be semi-circular in shape. Instead, the slots 100 of the divider 2 may resemble a circle with a portion 472 of the arc missing. More specifically, the shape of the slots 100 may be greater than a semi-circle. As a result, when the product stop 110 is inserted into the slots 100 the product stop 110 may snap into place within the slots 100. When snapped into place in the slots 100, the product stop 110 may be secured by more than gravity and an additional force must be used to insert or remove the product stop 110 from the slots 100. In this embodiment, the product stop 110 is more securely connected to the dividers 2.

Figure 3:
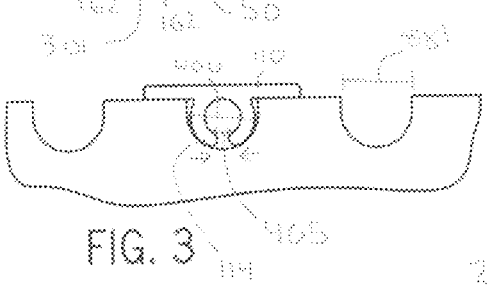
FIG. 3 illustrates a close up view of the top of one of the plurality of dividers wherein a product stop is inserted into a middle slot of the divider.

Referring now to FIG. 3, the bottom 114 of the product stop 110 may be largely cylindrical having a diameter 406. In an embodiment, the diameter 406 may be substantially similar to a diameter 881 of the slots 100, so as to fit snuggly within the slot 100. In an embodiment, an opening 405 may run along the entire product stop 110 from the first side 115 to the second side 116 of the product stop 110. The opening 405 may allow the overall diameter 406 of the bottom 114 of the product stop 110 to be slightly adjusted. More specifically, when snapping the product stop 110 into place within one of the slots 100 of the divider 2, the user may slightly compress the overall diameter 406 of the bottom 114 of the product stop 110. The compression of the bottom 114 of the product stop 110 within the slots 100 may further secure the product stop 110 and prevent movement of the same. The bottom 114 of the product stop 110 may remain in the compressed state while within the slots 100 and may spring back to the relaxed state, due to elastic memory, when the product stop 110 is removed from the slots 100.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. An adjustable shelving system comprising:

a first generally flat divider having a top, a bottom, a front, a back, a first side, a second side and a supportive base located at the bottom of the first generally flat divider;

a second generally flat divider having a top, a bottom, a front, a back, a first side, a second side and a supportive base located at the bottom of the second generally flat divider;

a shelf having a front and having a top side having openings and wherein the base of the first and the base of the second generally flat dividers contact and rest on the top side of the shelf;

an elongated bar having a first end, a second end, a top, and a bottom wherein the bottom is largely cylindrical and wherein the bottom has a diameter;

an elongated slit running along the entire bottom of the elongated bar from the first end of the elongated bar to the second end of the elongated bar wherein the elongated slit allows the diameter of the bottom of the elongated bar to be slightly compressed so as to allow the bottom of the elongated bar to alter its diameter and to fit snugly within one of a plurality of slots of the dividers;

wherein the plurality of slots are located at the top of the first and the top of the second generally flat dividers wherein at least one of the plurality of slots on each divider receives a portion of the elongated bar and wherein the elongated bar prevents an item placed on the shelf from moving farther away from the front of the shelf than the elongated bar is located and wherein the plurality of slots allows the elongated bar to be used regardless of the angle of the first or second generally flat dividers with respect to the front of the shelf; and an opening in the base of the first generally flat divider and an opening in the base of the second generally flat divider wherein a first pin is inserted through the opening of the base of the first generally flat divider and then through an opening of the top of the shelf and wherein a second pin is inserted through the opening of the base of the second generally flat divider and then through an opening of the top of the shelf and wherein the first and second pin secure the dividers to the shelf.

2. The adjustable shelving system of claim 1 wherein the top of the elongated bar is generally flat.

3. The adjustable shelving system of claim 1 further comprising:

a tapered edge of the base of the first generally flat divider forming an angle and a tapered edge of the base of the second generally flat divider forming an angle wherein the angle of the tapered edge of the base of the first generally flat divider and the angle of the base of the second generally divider is substantially equal to each other and substantially equal to an angle at which the first generally flat divider and the second generally flat divider are located with respect to the front of the shelf.

* * * * *